US006722502B1

(12) United States Patent
Newman

(10) Patent No.: US 6,722,502 B1
(45) Date of Patent: Apr. 20, 2004

(54) INFLATABLE CORNER CUSHION

(75) Inventor: Garry F. Newman, Castaic, CA (US)

(73) Assignee: Air Packaging Technologies, Inc., Valencia, CA (US)

( * ) Notice: Subject to any disclaimer, the term of this patent is extended or adjusted under 35 U.S.C. 154(b) by 203 days.

(21) Appl. No.: 10/097,046

(22) Filed: Mar. 12, 2002

(51) Int. Cl.[7] ..... B65D 81/02

(52) U.S. Cl. ..... 206/586; 206/522; 206/521; 206/453; 53/472

(58) Field of Search ..... 206/586, 522, 206/521, 453; 53/472

(56) References Cited

U.S. PATENT DOCUMENTS

| | | | | | |
|---|---|---|---|---|---|
| 3,144,236 | A | * | 8/1964 | Clanin | 150/154 |
| 4,465,188 | A | * | 8/1984 | Soroka et al. | 206/522 |
| 4,872,558 | A | | 10/1989 | Pharo | 206/522 |
| 4,874,093 | A | | 10/1989 | Pharo | 206/522 |
| 4,918,904 | A | | 4/1990 | Pharo | 53/472 |
| 4,949,530 | A | | 8/1990 | Pharo | 53/449 |
| 5,184,727 | A | | 2/1993 | Dickie et al. | 206/522 |
| 5,348,157 | A | * | 9/1994 | Pozzo | 206/522 |
| 5,351,829 | A | | 10/1994 | Batsford | 206/522 |
| 5,450,963 | A | * | 9/1995 | Carson | 206/524.8 |
| 5,487,470 | A | | 1/1996 | Pharo | 206/522 |
| 5,588,532 | A | | 12/1996 | Pharo | 206/522 |
| 5,711,691 | A | | 1/1998 | Damask et al. | 441/41 |
| 5,762,197 | A | * | 6/1998 | Farison | 206/522 |
| 5,857,571 | A | * | 1/1999 | Tschantz et al. | 206/522 |
| 5,862,914 | A | | 1/1999 | Farison et al. | 206/522 |
| 6,012,579 | A | * | 1/2000 | Tindoll et al. | 206/453 |
| 6,070,727 | A | * | 6/2000 | Tindoll et al. | 206/522 |
| 6,076,677 | A | | 6/2000 | Pozzo | 206/522 |
| 6,216,942 | B1 | | 4/2001 | Kittscher | 229/4.5 |
| 6,283,296 | B1 | | 9/2001 | Newman | 206/522 |

FOREIGN PATENT DOCUMENTS

EP 0692433 A1 * 1/1996

* cited by examiner

*Primary Examiner*—Mickey Yu
*Assistant Examiner*—Troy Arnold
(74) *Attorney, Agent, or Firm*—John R. Thompson; Stoel Rives LLP

(57) ABSTRACT

An inflatable corner cushion for protecting a corner of an object is disclosed. The inflatable corner cushion may have two triangular, inflatable cushions. Each cushion may have two edges meeting to form a V-shape. The two edges may be sealed together along the V-shaped edges such that, when the chambers are at least partially inflated, a combination of the chambers forms a pocket for enclosing a corner of an object. An inflatable coner cushion may be placed on each corner of an object. The objects and cushion may then be placed in a shipping box. In such a condition, the pocket surrounds each corner such that they are protected from impacts from all directions.

29 Claims, 6 Drawing Sheets

INFLATABLE CORNER CUSHION

BACKGROUND OF THE INVENTION

1. Field of the Invention

The present invention relates to packaging cushions and, more specifically, to air packaging cushions to protect and support a corner of an object.

2. Description of Related Art

Today, objects of all kinds are shipped through numerous shipping services, such as the United States Postal Service, United Parcel Service (UPS), and Federal Express. Literally billions of dollars in merchandise are shipped each year.

During shipment, many objects are subject to vibration, static electricity, shaking and bumping, and may also be dropped or thrown, either intentionally or unintentionally. Without proper packaging, many of the objects may be damaged or destroyed, resulting in significant losses, consumer dissatisfaction, and inconvenience. In addition, when shipped objects are damaged, costly disputes can often arise between the receiving party, the sending party, and/or the shipping party. Properly protecting an object during shipment is critical to numerous businesses.

Conventional packaging incorporates a variety of materials to protect and insulate an object within a shipping box. One of these materials is "bubble-pack." Bubble-pack consists of two layers of thin plastic material, such as polyethylene or vinyl formed with periodic bubbles between the layers.

Bubble-pack is bulky because it is produced in an inflated state and therefore expensive to ship and store. Furthermore, conventional bubble-pack provides limited protection in certain applications because of the fixed bubble diameter, height, and count in a given material area.

Another conventional packaging material employs preformed solid foam blocks made of, for example, polyurethane or polystyrene. These blocks limit the movement of the packaged object during travel. Unfortunately, they are bulky and expensive to ship and store. As these blocks are often shaped to conform to specific product, it is unlikely that they may be reused to ship other, even similar, products. Foam blocks are of fixed dimensions and, as a consequence, cannot be modified to suit a different product. Moreover, the blocks are often fragile and may be easily broken or fragmented during storage or usage, preventing reuse. Thus, foam blocks are often discarded after one use. In addition, the materials from which the blocks are made do not degrade rapidly and thus are not environmentally friendly.

Furthermore, when using conventional packaging, significant concerns arise in relation to the protection of narrow objects, such as picture frames or circuit boards (e.g., motherboards). Because they are narrow, many such objects are often inherently fragile. During shipment, the corners of such objects may receive the majority of any potentially damaging forces. As a consequence, it is critical to provide adequate protection to the corners of these objects. This protection must insulate a corner of an object from forces imposed from any direction (e.g., the top, bottom, or either side of the corner).

It would, therefore, be an advancement in the art to provide a packaging cushion for protecting the corners of a narrow object. It would further be an advancement in the art to provide such a packaging cushion that is durable, versatile, and reusable.

SUMMARY OF THE INVENTION

The present invention provides a reusable, inflatable corner cushion for protecting the corner of an object during shipment. The inflatable corner cushion may have two inflatable chambers. The inflatable chambers may, in one configuration, be triangular in shape. The chambers may be airtight such that they may contain a filler medium (e.g., air or foam).

In one implementation, each chamber may be formed from two gas-impervious composite laminate panels. The panels may be triangular and may be joined together by a heat seal along peripheral edges thereof.

In one embodiment, each chamber has two adjacent edges meeting to form a V-shape. A seal may join the V-shaped edges of each chamber such that, when each of the chambers is at least partially inflated with the filler medium, a combination of the chambers forms a pocket for enclosing a corner of an object. In such a condition, the chambers are positioned such the transverse axis of each chamber meets to form an acute angle, similar to an open-mouthed clam.

The pocket is well suited to protect a corner of a narrow object, such as picture frames or circuit boards. An inflatable corner cushion may be placed on each corner of the object being shipped. The cushions and the object may then be placed in a shipping box. In such a state, the pocket encloses the corner of the object such that it is insulated from impacts from any direction. Also, because of the fluid nature of the filler medium, the inflatable corner cushion rapidly redistributes and diffuses potentially damaging impacts. As an added benefit, in the course of properly protecting the corners of the shipped object, the object may thus be suspended, providing a buffer around the remainder of the object.

In one configuration, at least one of the chambers further comprises a conjoined segment. The conjoined segment is a union between opposing sides of a chamber and limits the size of the chamber when containing the filler medium. In one embodiment, the conjoined segment "flattens" the top edge of the inflatable corner cushion such that it better conforms to the shape of the shipping box.

The inflatable corner cushion may also have a transfer channel for communicating filler medium between the chambers. The transfer channel may include mating holes formed in each chamber, where the area surrounding each hole is sealed together. In an alternative embodiment, the channel simply may be a tube joining the two chambers. The transfer channel serves a number of purposes. For example, it enables an impact received at one chamber to be diffused and redistributed between both chambers, not just the chamber receiving the impact. The transfer channel further allows inflation and deflation of both chambers from a single entry point.

The inflatable corner cushion may also have a valve for selectively communicating the filler medium into and out of one of the chambers. The valve may be a self-closing and self-sealing flat valve, which may be formed from two, small plastic strips sealed together along the longitudinal peripheral edges, to form an air passageway. The passageway is coated with an adhesive that permits selective inflation and deflation of the chamber. In one embodiment, because of the transfer channel, a single valve may be used to inflate and deflate both chambers.

The inflatable corner cushion offers a number of advantages over other conventional corner packaging. The inflatable corner cushion may, for example, be shipped and stored in a deflated condition, thereby reducing the expense of shipment and storage. Because of the fluid nature of a filler medium contained within inflatable corner cushion, it rapidly absorbs and redistributes forces acting on the cushion, thereby protecting delicate items during shipment. When air is used as a filler medium, the vast majority of the volume of the inflatable corner cushion is a natural product, which does not threaten the environment. In addition, the inflatable corner cushion is durable, yet flexible, and thus can be reused many times to protect the same or similar items during shipment. In many cases, the materials used to make the inflatable corner cushion are less costly to recycle than the materials used to make conventional pre-formed foam blocks.

These and other features and advantages of the present invention will become more fully apparent from the following description and appended claims, or may be learned by the practice of the invention as set forth hereinafter.

BRIEF DESCRIPTION OF THE DRAWINGS

In order that the manner in which the above-recited and other advantages and objects of the invention are obtained will be readily understood, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

The presently preferred embodiments of the present invention will be best understood by reference to the drawings, wherein like parts are designated by like numerals throughout. It will be readily understood that the components of the present invention, as generally described and illustrated in the figures herein, could be arranged and designed in a wide variety of different configurations. Thus, the following more detailed description of the embodiments of the present invention, as represented in FIGS. 1 through 9, is not intended to limit the scope of the invention, as claimed, but is merely representative of presently preferred embodiments of the invention.

Figure 1:
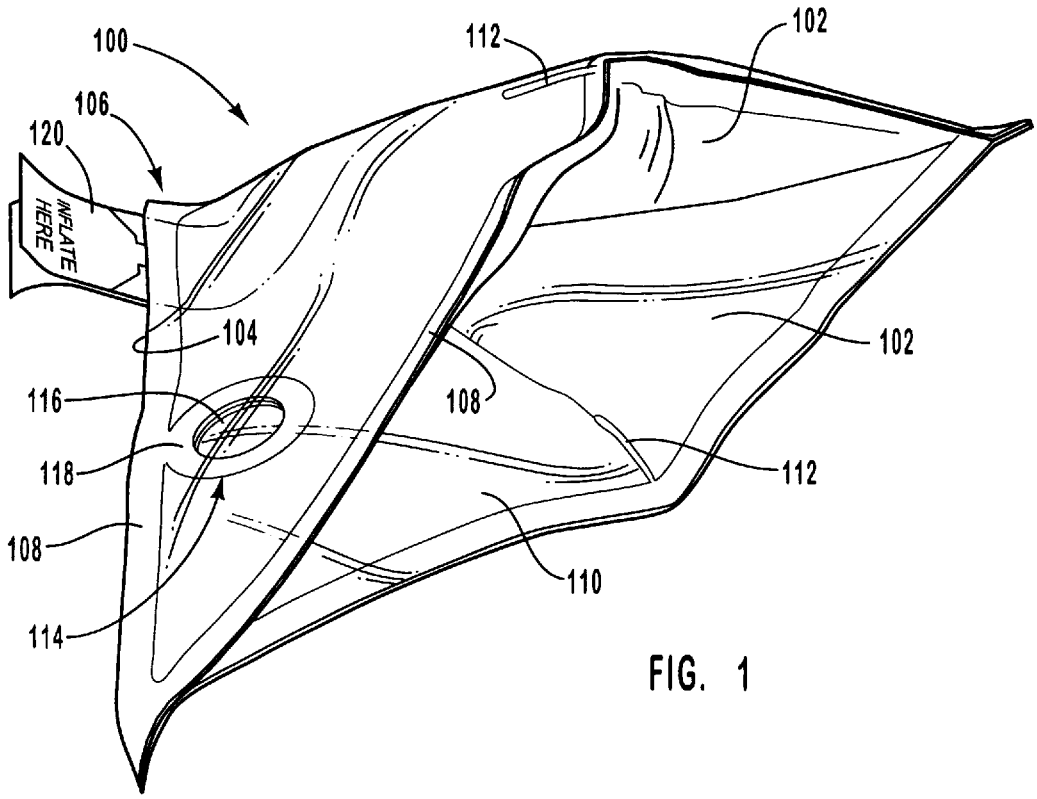
FIG. 1 is a perspective view of an inflatable corner cushion.
Figure 2:
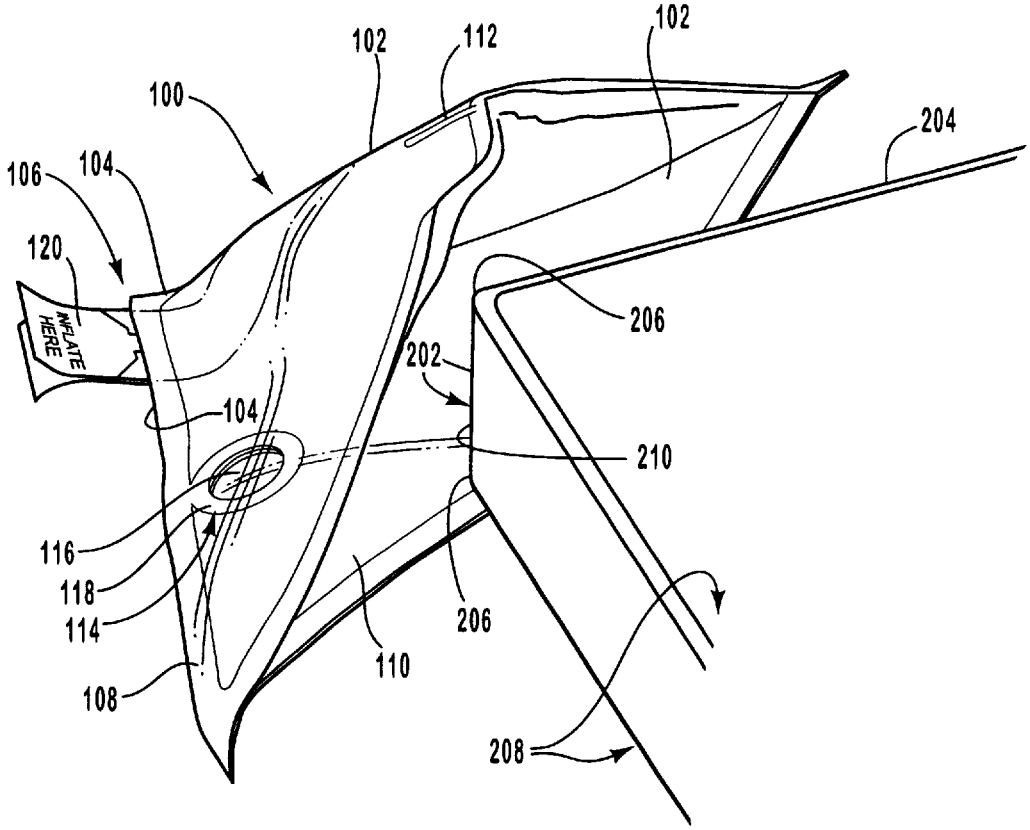
FIG. 2 illustrates insertion of an object into a pocket of the inflatable corner cushion.

Referring to FIGS. 1 and 2, the inflatable corner cushion 100 may have two inflatable chambers 102. The chambers 102 are airtight such that they may contain a filler medium. In one implementation, the filler medium may be a gas (e.g., air, helium, or carbon dioxide), foam, or a suitable liquid (e.g., water). Also, each of the two chambers 102 may contain two or more sub-chambers, possibly in fluid communication with each other, without departing from the scope and spirit of this invention. In one embodiment, the chambers 102 are made from a gas-impervious composite laminate, which is discussed in detail below.

Each chamber 102 may have two adjacent edges 104 meeting to form a V-shape, i.e., V-shaped edges 106. In one implementation, the V-shaped edges 106 meet at approximately a 90° angle. In such an implementation, the inflatable corner cushion 100 may be conveniently positioned within a shipping box (not shown) having an interior 90° angle. As those skilled in the art will understand, the V-shaped edges 106 may meet at other angles to conform to various types of shipping boxes without departing from the scope and spirit of this invention.

The V-shaped edges 106 of each chamber 102 may be joined together by a seal 108. In one implementation, as illustrated in FIG. 2, the seal 108 is V-shaped and is coextensive with the V-shaped edges 106.

Numerous known techniques may be employed to join edges 104 of each chamber 102 together. For example, the seal 108 may be heat-induced, i.e., a heat seal. Numerous welding methods could be employed, including both sonic (e.g., ultrasonic) and electromagnetic (e.g., radio frequency) techniques. Various chemical reactions or adhesives may be used to create a seal 108, including ultraviolet or electron beam cured adhesives. Also, the simple application of high pressure may create a seal 108 between certain types of composite laminates. Permanently attachable crimping devices may likewise be employed to hold the chambers 102 together.

When the chambers 102 are sealed together along the V-Shaped edges 106 and at least partially inflated with the filler medium, a combination of the chambers 102 forms a pocket 110 for enclosing a corner 202 of an object 204, i.e., surrounding and providing protection to the corner 202. When enclosed in a pocket 110, the corner 202 is protected from potentially damaging impacts or blows.

FIG. 2 illustrates insertion of a corner 202 of an object 204 into a pocket 110 of the inflatable corner cushion 102. In this context, a corner 202 may be defined in a number of different ways. Speaking broadly, a corner 202 is a region where at least two surfaces, edges, and/or lines meet. FIG. 2 illustrates a corner 202 having two points 206, each point 206 abutting opposing sides of the object 208. Thus, in one implementation, the pocket 110 may enclose a corner 202 that abuts opposing sides of an object 208, such as a narrow object (e.g., a picture frame or motherboard). In other words, the pocket 110 may simultaneously enclose both points 206 of such a corner 202, not just one of the points 206. The opposing sides of the object 208, of course, need not be parallel to each other. The corner 202 may also be rounded or beveled, so long as the "corner" 202 abuts opposing sides of the object 208. With respect to a rounded and elongated object 204 (e.g., a pencil), either end of the pencil may be referred to as a corner.

Referring again to both FIGS. 1 and 2, in one embodiment, a transfer channel 114 communicates filler medium between the two chambers 102. The transfer channel 114 may be configured in numerous ways. By way of example, the channel 114 may be mating holes 116 formed in each chamber 102, where an area 118 surrounding each hole is sealed together. The transfer channel 114 may also be a tube (not shown) joining the two chambers 102. Those skilled in the art understand that the transfer channel 114 may be configured in various ways within the scope of this invention. For example, the transfer channel 114 may be embodied in various shapes (e.g., round, square, rectangular) or be located a different positions within the inflatable corner cushion 100.

In addition, the inflatable corner cushion 100 may further comprise a valve 120 for selectively communicating the filler medium into and out of at least one of the chambers 102. For example, the valve 120 may be a flat valve, such as is disclosed in U.S. Pat. No. 5,711,691, which is hereby incorporated by this reference. Those skilled in the art will understand that numerous other types of valves 120, such as push-pull valves, may be implemented in connection with this invention.

In one implementation, one valve 120 may inflate both inflatable chambers 102 because the chambers 102 are in fluid communication via the transfer channel 114. Alternatively, where no transfer channel 114 is present, a separate valve 120 may be in fluid communication with each chamber 102, as will be discussed in connection with FIG. 9. The latter embodiment may be better suited to protect heavy objects. The valve 120, or valves, may be configured to interface with pumps of various kinds or may also be used to fill the chambers 102 through human lung power.

It should be noted that the inflatable corner cushion 100 might not require a valve 120, being, for example, inflated with the filler medium at the time of manufacture. As an additional example, reactants (e.g., baking soda and vinegar) capable of combining to produce gas to fill a chamber 102 may be separated and placed in discrete capsules within the chamber. The capsules may be broken, combining the reactants, to fill the chamber 102 at a subsequent time.

Figure 3:
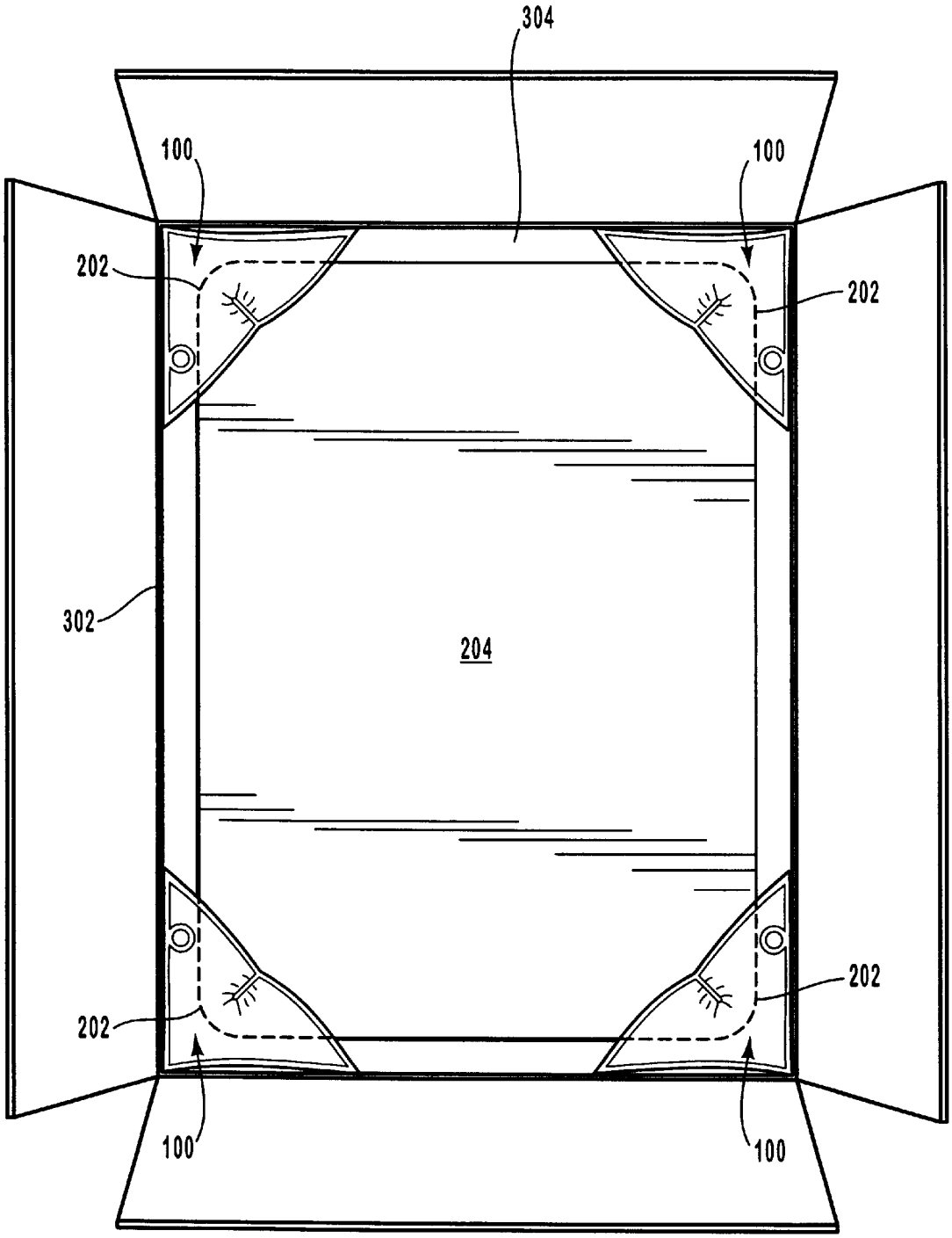
FIG. 3 is a top plan view of four inflatable corner cushions used in connection with a shipping box.

FIG. 3 is a top view of four inflatable corner cushions 100 used in connection with a shipping box 302. As illustrated, an inflatable corner cushion 100 surrounds and encompasses each of the four corners 202 of the object 204. The inflatable corner cushions 100 and the object 204 are snugly positioned within a shipping box 302. In this configuration, the inflatable corner cushions 100 absorb shocks and blows to the box 302 from any direction. In many cases, a blow to the shipping box 302 will be received at the corners 202 where it can be absorbed directly by one of the inflatable corner cushions 100. Moreover, the inflatable corner cushions 100 suspend the object 204 away from the shipping box 302 to provide a buffer 304 for protection to the object, should a blow be delivered elsewhere. In this suspended state, the risk of damage to due vibration is substantially decreased.

It should be noted that the inflatable corner cushion 100 is not limited to a particular size and may be manufactured to suit a particular shipping box 302 or object 202.

Figure 4:
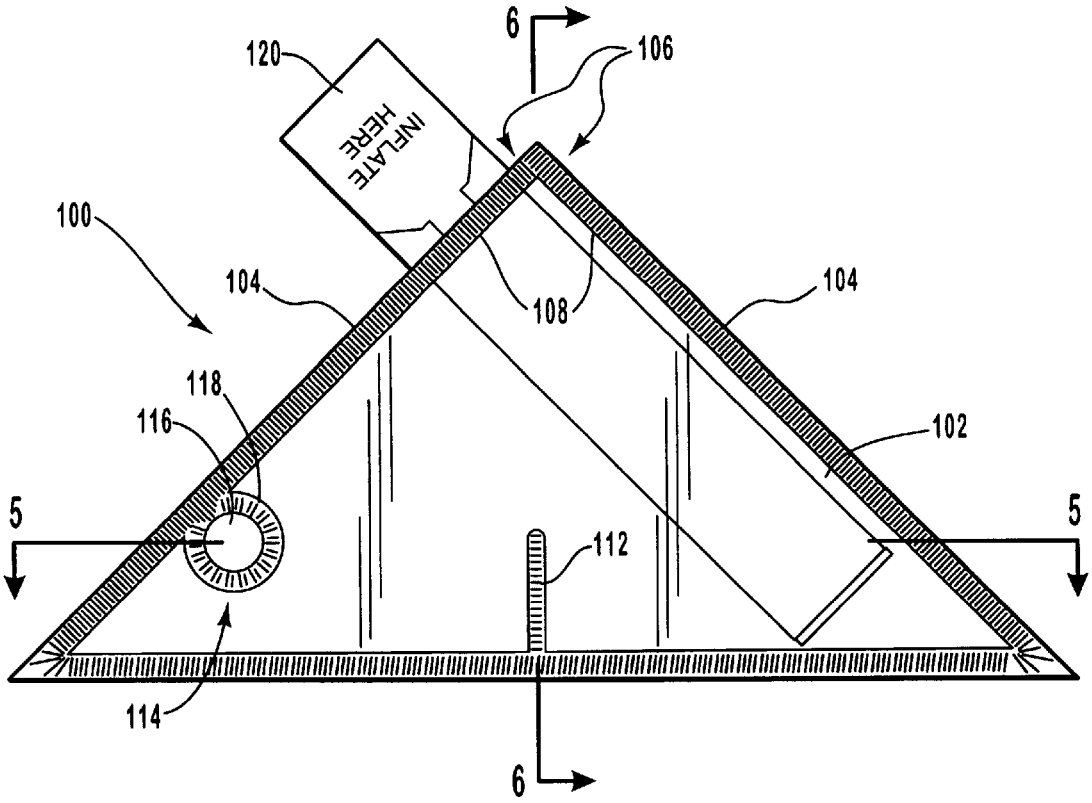
FIG. 4 is a top plan view of the inflatable corner cushion.

FIG. 4 is a top view of the inflatable corner cushion 100 in an inflated state.

The top view of the inflatable corner cushion 100 illustrates two edges 104 of a chamber 102 meeting to form V-shaped edges 106 and simultaneously illustrates a V-shaped seal 108 joining the two chambers 102.

In addition, this view illustrates a conjoined segment 112, which may be included in various embodiments of the inflatable corner cushion 100. The conjoined segment 112, as illustrated, is linear in shape. However, other shapes and configurations serve the same purpose of limiting the size of the chamber 102 when inflated and enabling the inflatable corner cushion 100 to more closely conform to the shape of a shipping box. For example, the conjoined segment 112 may be circular or rectangular in shape. In one implementation, the conjoined segment 112 may surround a non-inflatable region. Also, each chamber 102 may have more than one conjoined segment 112. Of course, not all embodiments of the inflatable corner cushion 100 include a conjoined segment 112.

Figure 5:
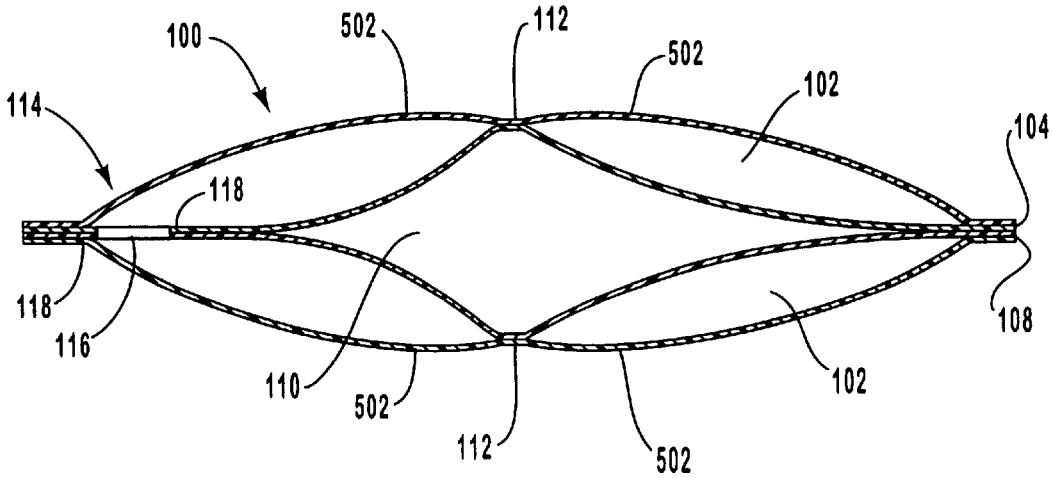
FIG. 5 is a cross-sectional view of the inflatable corner cushion.

FIG. 5 is a cross-sectional view of the inflatable corner cushion 100 when each of the chambers 102 is at least partially inflated with the filler medium. This view illustrates how the conjoined segment 112 limits the size of the inflatable chamber 102. Furthermore, when in a shipping box, the conjoined segment 112 provides more stability to the inflatable corner cushion 1 00 by causing four portions 502 of the chamber 102 to contact the box.

FIG. 5 further illustrates one embodiment of the transfer channel 114. Again, an area 118 surrounding the mating holes 116 is sealed together to form the transfer channel 114.

Figure 6:
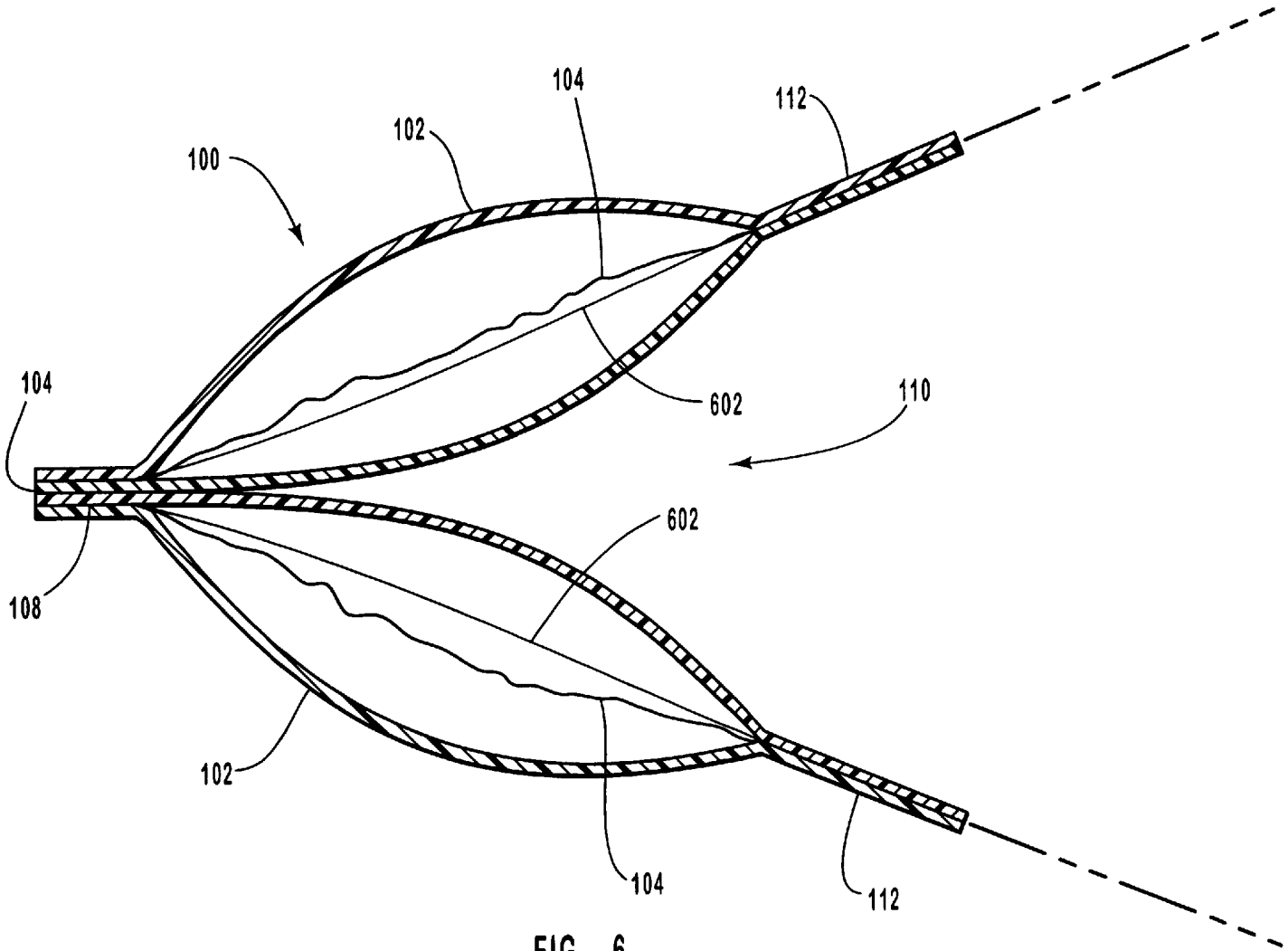
FIG. 6 is a second cross-sectional view of the inflatable corner cushion.

FIG. 6 is a second cross-sectional view of the inflatable corner cushion 100 in an inflated state. This view illustrates the transverse axis 602 of each chamber. In one configuration, the transverse axis 602 of each chamber 102 meet to form an acute angle (an angle less than 90°). This acute angle causes each chamber 102 to encompass the corner of an object within the pocket 110 and provide protection to the corner from all directions.

Figure 7:
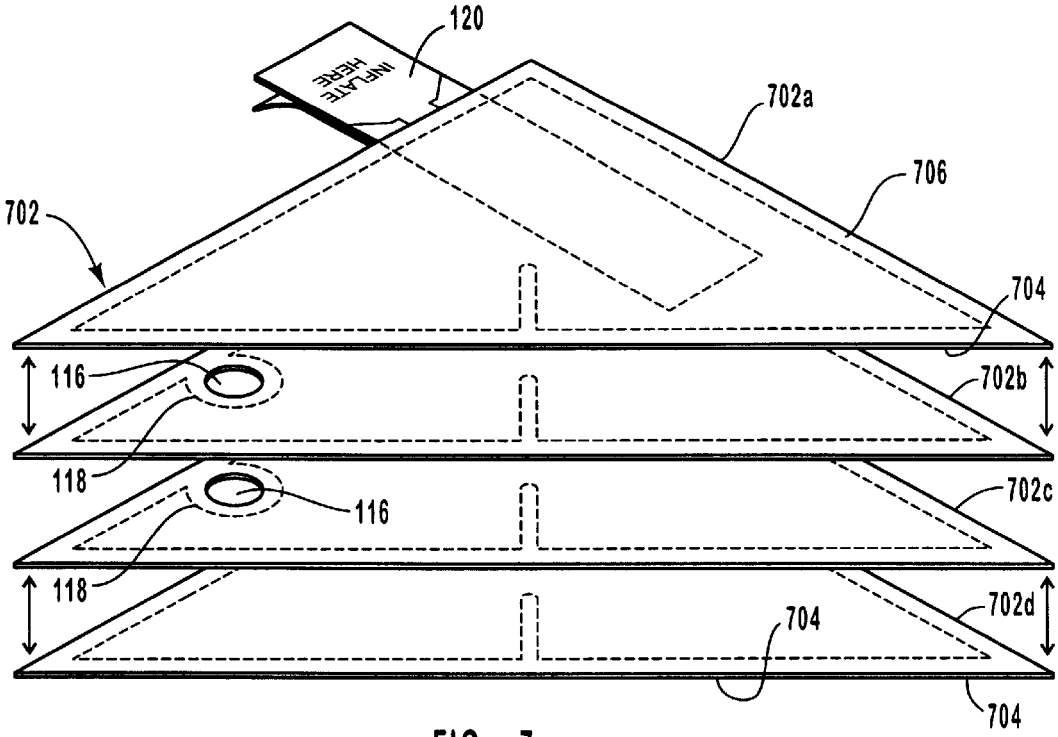
FIG. 7 illustrates panels that may be used to form the inflatable corner cushion.
Figure 8:
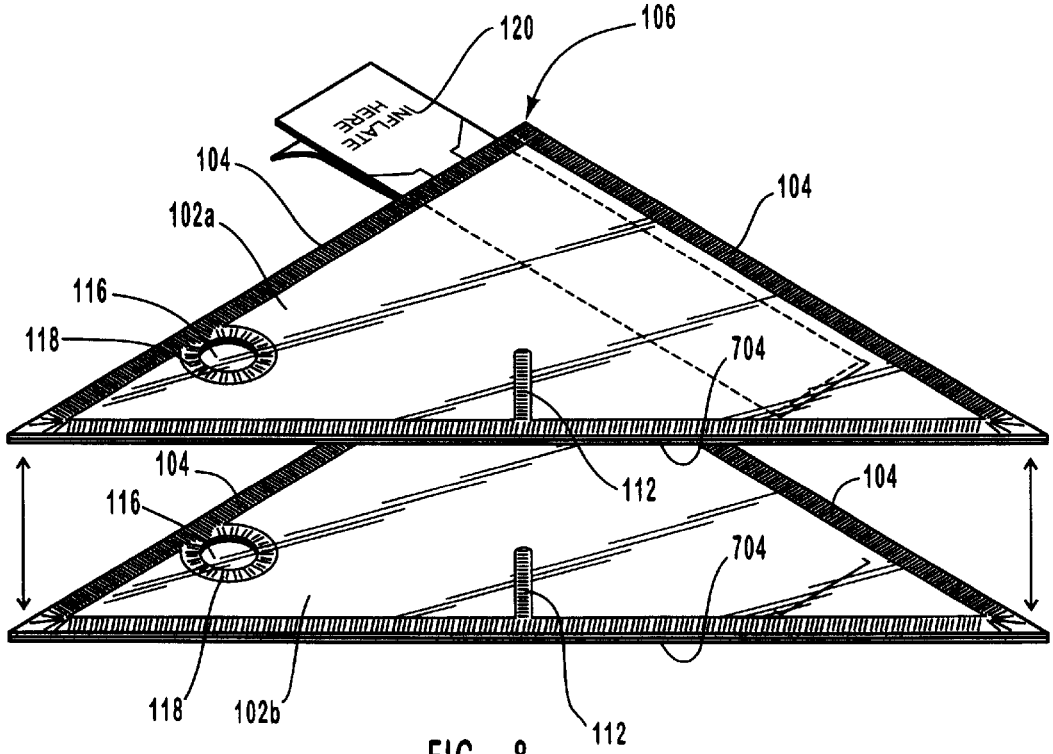
FIG. 8 illustrates two chambers that may be used to form the inflatable corner cushion.

FIGS. 7 and 8 illustrate one method of forming an inflatable corner cushion 100 100. Four panels 702 may be used to form the inflatable corner cushion 100. The panels 702 may be coextensive and, in one embodiment, may be triangular in shape.

In this application, triangular means substantially triangular. The term "substantially triangular" signifies, for example, that the corners of the triangle may be rounded, or that the edges of the triangle may be concave, convex or even jagged. In one embodiment, substantially triangular signifies that mouth-forming edges 704 of the panels 702, the edges of the panels 702 that will form a mouth around the pocket 110, may have various protrusions or inward deviations without departing from the scope and spirit of this invention.

The panels 702 may be formed from a wide variety of known materials. For example, the panels 702 may be made of a gas-impervious composite laminate. Many types of composite laminates are known to those skilled in the art. Each panel 702 may be formed, for instance, from puncture resistant sheets or laminates of polyethylene or of metalized nylon or a similar material often referred to as "Mylar." The panels 702 may also comprise an intermediate layer of aluminum and inner and outer layers of a plastic heat-sealable coating, such as polyethylene, adapted to melt in the range of 300° Fahrenheit. These composite laminates, which may be constructed to be highly flexible and inextensible or extensible, may be formed from two thin films bonded together with a known adhesive or brought together using hot fluid polyethylene as a bonding agent. In an alternative implementation, the panels 702 may be constructed of a rigid, lightweight material, such as a gas-impervious plastic of the type sometimes used to make suitcases.

In one embodiment, the composite laminate has a thickness in the range of one (1) to about ten (10) mils. Heavier objects may be accommodated by increasing the thickness and consequently the strength of the panels 702.

In one implementation, the panels 702 may be configured to dissipate static in order to protect electrically sensitive objects, such as circuit boards, from transient charges. To do so, for instance, the panels 702 may be coated or formed with a static dissipative substance.

A first chamber 102*a* may be made by joining a first and a second panel 702*a*, 702*b* together. A second chamber 102*b* may be made by joining a third and fourth panel together 702*c*, 702*d*. The panels 702 may be joined together along peripheral edges 706 of each panel. The chambers 102 may, of course, be triangular in shape. Also, the numerous methods referenced above to seal the two chambers 102 together may likewise be used to seal the panels 702 together. In an alternative embodiment, a chamber 102 may be formed, for example, from a single rectangular- or square-shaped panel folded over and sealed to itself to form a triangular-shaped chamber.

In one implementation, a flat valve 120 may be sealed between the first and second panels 702*a*, 702*b* or the third and fourth panels 702*c*, 702*d* for inflation and deflation of the corresponding chamber 102. As stated above, in one configuration, each chamber 102 may be equipped with a valve 120 for inflation and deflation thereof.

After or simultaneous with the sealing of the panels 702 together, the V-shaped edges 106 of each chamber 102 may be joined together. When at least partially inflated with a filler medium, a combination of the chambers 102 forms a pocket 110 for receiving a corner 202 of an object 204, as discussed in connection with FIGS. 1 and 2. An area 118 surrounding each of the mating holes 116 may also be sealed together, using any of the sealing methods discussed above, to form a transfer channel 114 for communication of the filler medium between the chambers 102.

Figure 9:
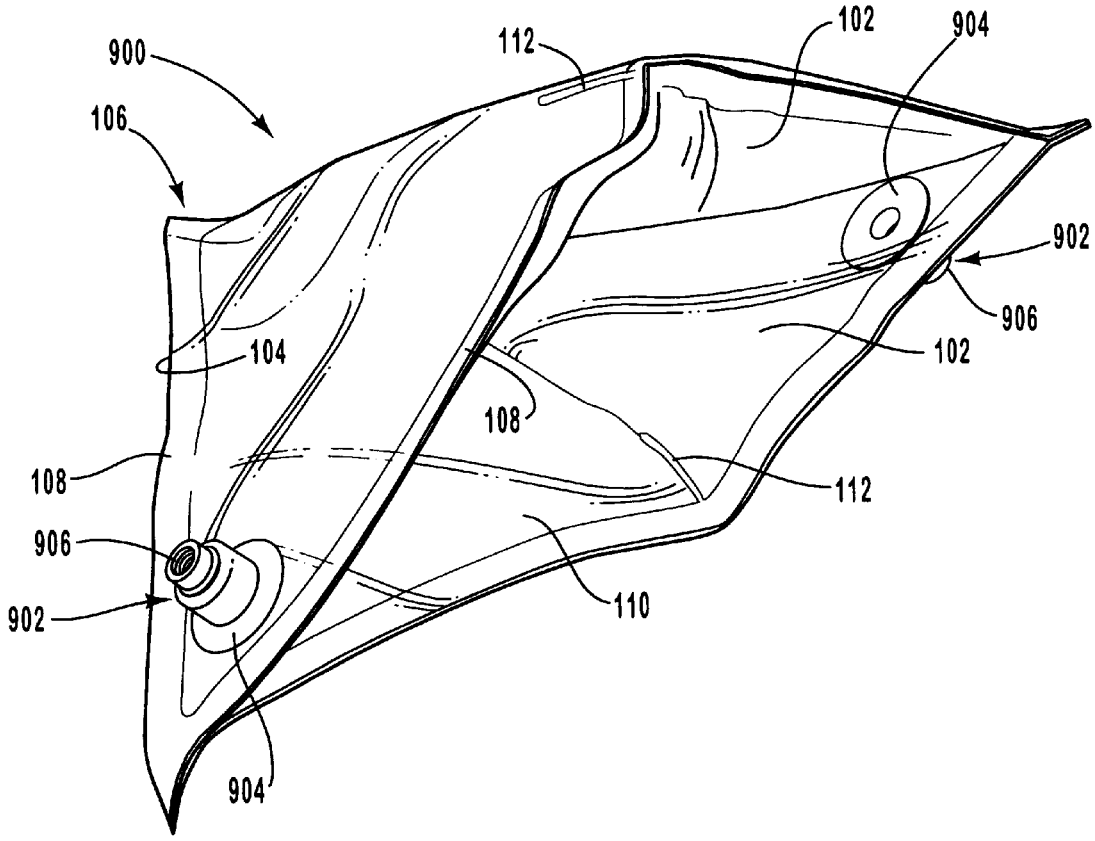
FIG. 9 is a perspective view of an alternative embodiment of inflatable corner cushion.

FIG. 9 illustrates an alternative embodiment of the inflatable corner cushion 100. In the illustrated embodiment, no transfer channel 114 is present. As such, the chambers 102 are not in communication with each other. Each chamber 102 includes a separate valve 120, such as a push-pull valve 902, for selectively communicating filler medium to and from the corresponding chamber 102.

The push-pull valve 902 includes a body 902 at least partially disposed within a chamber 102 and a stem 906 movable between an open and a closed position. Pulling the stem 906 away from the body 904 opens the valve 902 and pushing the stem 906 toward the body 904 closes the valve 902. One embodiment of the push-pull valve 902 is disclosed in U.S. Pat. No. 2,859,932, which is hereby incorporated by this reference. Of course, other types of valves 120, such as a flat valve, and other variations of the push-pull valve 902 come within the scope of this invention.

As discussed, the inflatable corner cushion 100 offers a number of advantages over other conventional corner packaging. The inflatable corner cushion 100 may, for example, be shipped and stored in a deflated condition, thereby reducing the expense of shipment and storage. Because of the fluid nature of a filler medium contained within inflatable corner cushion, it rapidly absorbs and redistributes forces acting on the cushion, thereby protecting delicate items during shipment. When air is used as a filler medium, the vast majority of the volume of the inflatable corner cushion 100 is a natural product, which threatens no damage to the environment. In addition, the inflatable corner cushion 100 is durable, yet flexible, and thus can be reused many times to protect the same or similar items during shipment. In many cases, the materials used to make the inflatable corner cushion 100 are less costly to recycle than the materials used to make pre-formed solid foam blocks.

The present invention may be embodied in other specific forms without departing from its structures, methods, or other essential characteristics as broadly described herein and claimed hereinafter. The described embodiments are to be considered in all respects only as illustrative, and not restrictive. The scope of the invention is, therefore, indicated by the appended claims, rather than by the foregoing description. All changes that come within the meaning and range of equivalency of the claims are to be embraced within their scope.

What is claimed and desired to be secured by United States Letters Patent is:

1. A reusable packaging cushion for protecting a corner of an object, the cushion comprising:

two triangular and inflatable chambers, each chamber having two adjacent edges meeting to form a V-shape, each chamber configured to contain a filler medium; and a seal joining the V-shaped edges of each chamber such that, when each of the chambers is at least partially inflated with the filler medium, a combination of the chambers forms a pocket for enclosing a corner of an object.

2. The cushion of claim 1, wherein the transverse axis of each chamber meet to form an acute angle.

3. The cushion of claim 1, wherein the seal comprises a heat seal.

4. The cushion of claim 1, wherein each of the chambers comprises opposing panels joined together by a heat seal along peripheral edges of the panels.

5. The cushion of claim 4, wherein the panels comprise a gas-impervious composite laminate.

6. The cushion of claim 1, wherein at least one of the chambers further comprises a conjoined segment, the conjoined segment comprising a union between opposing sides of a chamber and configured to limit the size of the chamber when containing the filler medium.

7. The cushion of claim 1, further comprising a transfer channel configured to communicate filler medium between the chambers.

8. The cushion of claim 1, further comprising at least one valve configured to selectively communicate the filler medium into and out of one of the chambers.

9. The cushion of claim 8, wherein the valve is a flat valve.

10. The cushion of claim 8, wherein the valve is a push-pull valve.

11. The cushion of claim 1, further comprising a first and a second valve, wherein the first valve is configured to selectively communicate filler medium into a first one of the two chambers and the second valve is configured to selectively communicate filler medium into a second one of two chambers.

12. The cushion of claim 1, wherein the filler medium comprises a gas.

13. A reusable packaging cushion for protecting a corner of an object, the cushion comprising:

a first triangular and inflatable chamber comprising a first panel and a second panel joined together;

a second triangular and inflatable chamber comprising a third panel and a fourth panel joined together, each chamber configured to contain a filler medium; and a V-shaped seal joining the first and the second chambers such that, when each of the chambers is at least partially inflated with the filler medium, a combination of the chambers forms a pocket for enclosing a corner of an object.

14. The cushion of claim 13, wherein the transverse axis of each chamber meet to form an acute angle.

15. The cushion of claim 13, wherein the V-shaped seal comprises a heat seal.

16. The cushion of claim 13, wherein at least one of the chambers further comprises a conjoined segment, the conjoined segment comprising a union between opposing sides of a chamber and configured to limit the size of the chamber when containing the filler medium.

17. The cushion of claim 13, further comprising a transfer channel configured to communicate filler medium between the chambers.

18. The cushion of claim 17, further comprising at least one valve configured to selectively communicate the filler medium into and out of one of the chambers.

19. The cushion of claim 18, wherein the valve is a flat valve.

20. The cushion of claim 18, wherein the valve is a push-pull valve.

21. The cushion of claim 13, further comprising a first and a second valve, wherein the first valve is configured to selectively communicate filler medium into the first chamber and the second valve is configured to selectively communicate filler medium into the second chamber.

22. The cushion of claim 13, wherein the filler medium comprises a gas.

23. A reusable packaging cushion for protecting a corner of an object, the cushion comprising:

a first triangular and inflatable chamber comprising a first and a second triangular panel joined together by a heat seal along peripheral edges of the first and second panels;

a second triangular and inflatable chamber comprising a third and a fourth triangular panel joined together by a heat seal along peripheral edges of the third and fourth panels, each chamber having two adjacent edges meeting to form a V-shape, each chamber configured to contain a filler medium; and a seal joining the V-shaped edges of each chamber such that, when each of the chambers is at least partially inflated with the filler medium, a combination of the chambers forms a pocket for enclosing a corner of an object.

24. The cushion of claim 23, wherein the transverse axis of each chamber meet to form an acute angle.

25. The cushion of claim 23, wherein the seal comprises a heat seal.

26. The cushion of claim 23, wherein at least one of the chambers further comprises a conjoined segment, the conjoined segment comprising a union between opposing sides of a chamber and configured to limit the size of the chamber when containing the filler medium.

27. The cushion of claim 23, further comprising a transfer channel configured to communicate filler medium between the chambers.

28. The cushion of claim 27, further comprising at least one valve configured to selectively communicate the filler medium into and out of one of the chambers.

29. The cushion of claim 27, wherein the filler medium comprises a gas.

* * * * *